United States Patent [19]

Ebner

[11] 4,194,710

[45] Mar. 25, 1980

[54] TUMBLING MILL

[76] Inventor: Josef E. Ebner, Palffygasse 18/10, A-1170 Vienna, Austria

[21] Appl. No.: 917,301

[22] Filed: Jun. 20, 1978

[51] Int. Cl.[2] ..... B02C 17/22

[52] U.S. Cl. ..... 241/182; 241/299

[58] Field of Search ..... 241/181–183, 241/284, 299

[56] References Cited

U.S. PATENT DOCUMENTS

| | | | |
|---|---|---|---|
| 1,538,620 | 5/1925 | Canada | 241/183 |
| 2,193,956 | 3/1940 | Abrams | 241/183 |
| 2,998,201 | 8/1961 | Ratkowski | 241/183 |
| 3,880,365 | 4/1975 | Elgner | 241/182 |

FOREIGN PATENT DOCUMENTS

| | | |
|---|---|---|
| 283092 | 7/1970 | Austria . |
| 309963 | 9/1973 | Austria . |
| 329357 | 5/1976 | Austria . |
| 333578 | 11/1976 | Austria . |
| 422488 | 4/1967 | Switzerland . |
| 1431618 | 4/1976 | United Kingdom . |

*Primary Examiner*—Howard N. Goldberg
*Attorney, Agent, or Firm*—Fleit & Jacobson

[57] ABSTRACT

This invention relates to a tumbling mill which has a generally polygonal liner, which defines a grinding chamber. The cross-section of the grinding chamber is defined by liner plates and is generally polygonal and preferably approximately square. At the corners, the liner plates are directly supported on the inside surface of a shell which surrounds the liner. Elsewhere, the liner plates are supported on the inside surface by spacers. The liner plates extend along elliptic arcs on the inside of the shell.

10 Claims, 8 Drawing Figures

TUMBLING MILL

SUMMARY OF THE INVENTION

Figure 1:
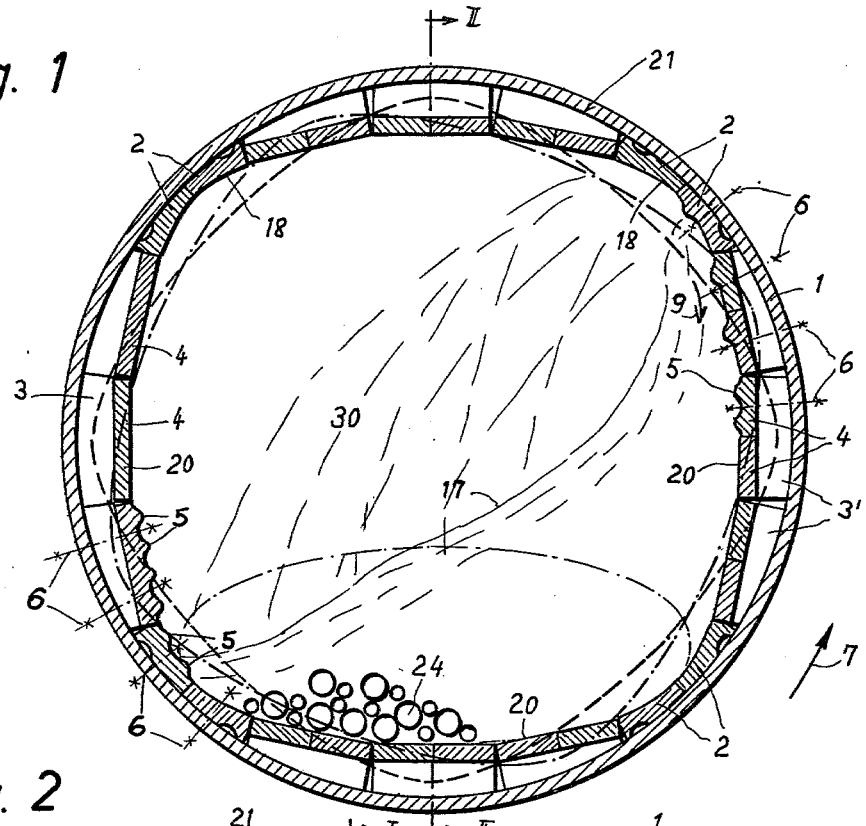

A tumbling mill comprises a shell and a generally polygonal liner, which is disposed on the inside surface of the shell and defines a grinding chamber and comprises liner plates which define elliptic arcs. Part of said liner plates are mounted on spacers.

BACKGROUND OF THE INVENTION

In a tumbling mill having a grinding chamber which is circular in cross-section, the grinding elements are entrained along the periphery of the grinding chamber in the direction of rotation, specifically in a direction which is tangential to the cross-section. This is accomplished by undulations or ribs or the like. In addition to said entraining action, no entraining action is exerted on the grinding elements by centrifugal force. Besides, the circular cross-section of the grinding chamber does not result in a variation of the angle of separation at which the grinding elements enter their parabolic trajectory. This is one of the causes for the poor disintegration efficiency of such tumbling mills having a grinding chamber which is circular in cross-section. This poor disintegration efficiency is due to the fact that the small turbulence in the space occupied by the grinding elements results in a reduced number of fracturing events to which the material being ground is subjected. In a tube mill having a grinding chamber which is quadrangular in cross-section and has corners which are rounded along arcs of a circle, as is known, e.g., from Swiss Patent Specification No. 422,488, the variaton of the entraining component of force exerted on the grinding elements as a result of centrifugal force is relatively small at the corners. To increase the variation of that entraining component of force and the variation of the angle of separation, it is known to decrease the radius of curvature at the corners although this results in a great decrease of the volume of the grinding chamber compared to the conventional grinding chamber which is circular in cross-section and in extreme cases the throughput capacity of the mill may be reduced. Another undesired result of the smaller radius of curvature at the corners resides in that higher spacers are required for the grinding plates and the associated fasteners must be longer.

A further disadvantage resides in the heavy wear. Owing to a strong sliding movement between the smooth liner and the grinding elements, this wear is particularly heavy at the transition between the trailing end of the rounded corner and the straight side of the square because the radial acceleration is discontinuous there.

It is an object of the invention to increase the variation of the angle of separation and thus to increase the turbulence in the grinding chamber by an increase of the variation of the entraining component of force adjacent to the corners, also to reduce the irregular wear and to increase the service life of the liner plates, to provide a more desirable structure, which permits the use of more uniform liner plates, and to limit the height of the spacers for the liner plates and the length of the fastening screws.

Finally it is an object of the invention so to design the internal fixtures of the tumbuling mill that the liner plates and the spacers for such plates can be replaced individually.

Figure 2:
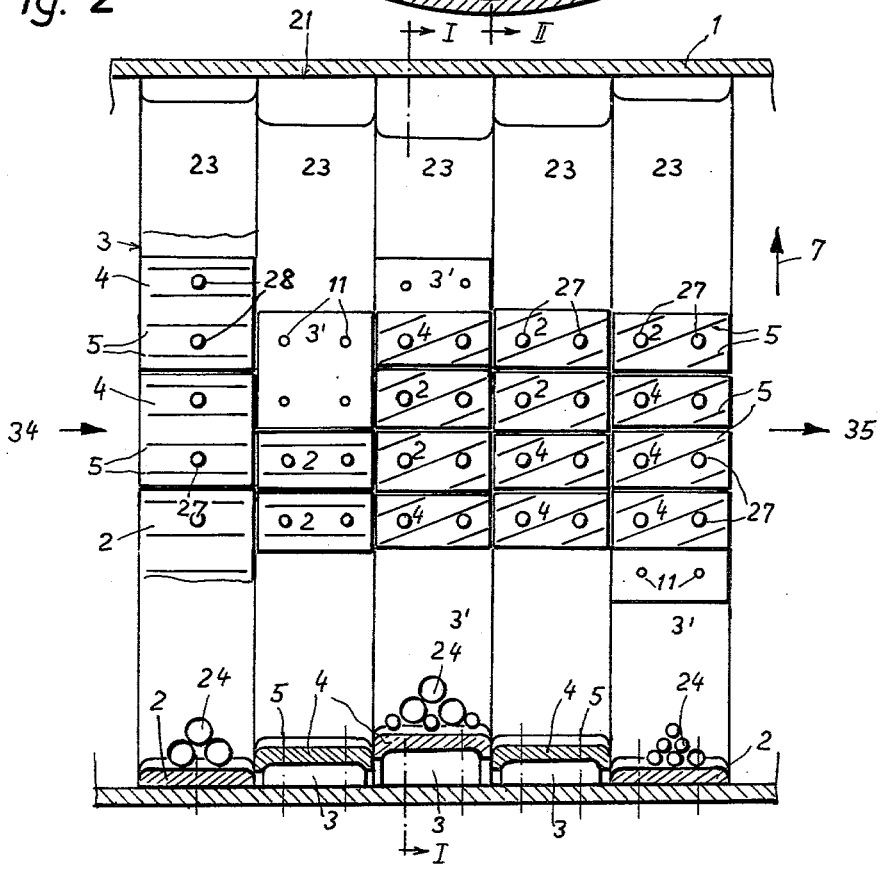
Figure 3:
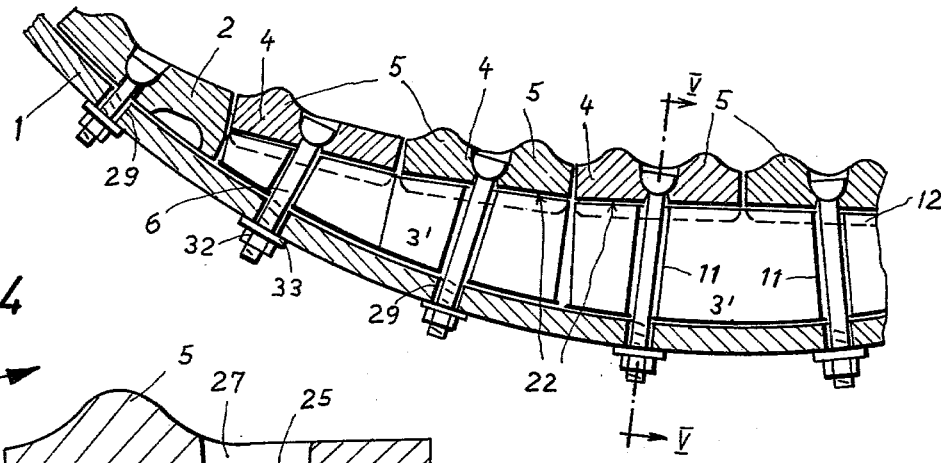

An illustrative embodiment of the tumbling mill according to the invention is shown on the accompanying drawing, in which FIG. 1 is a transverse sectional view showing the grinding chamber, FIG. 2 a longitudinal sectional view taken on line II—II in FIG. 1 and FIG. 3 an enlarged view showing a detail of FIG. 1, with liner plates comprising single and double undulations. Such plates can be selectively used.

Figure 4:
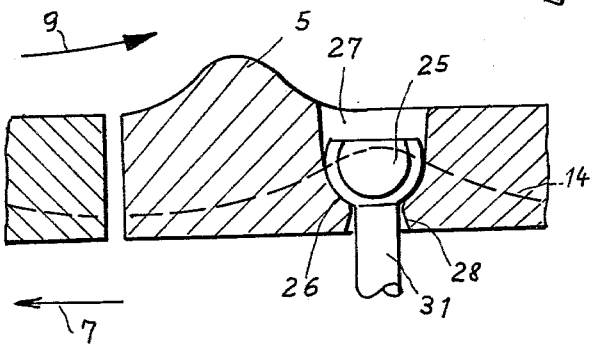
Figure 5:
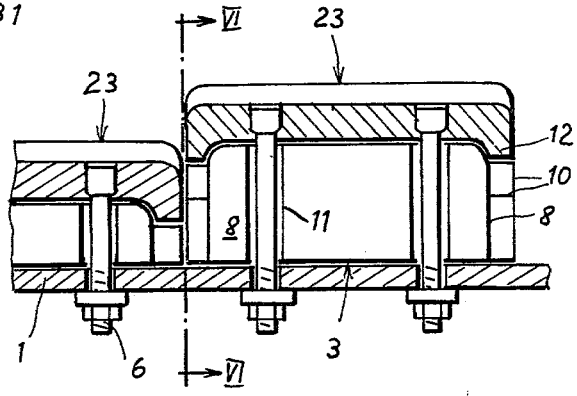
Figure 6:
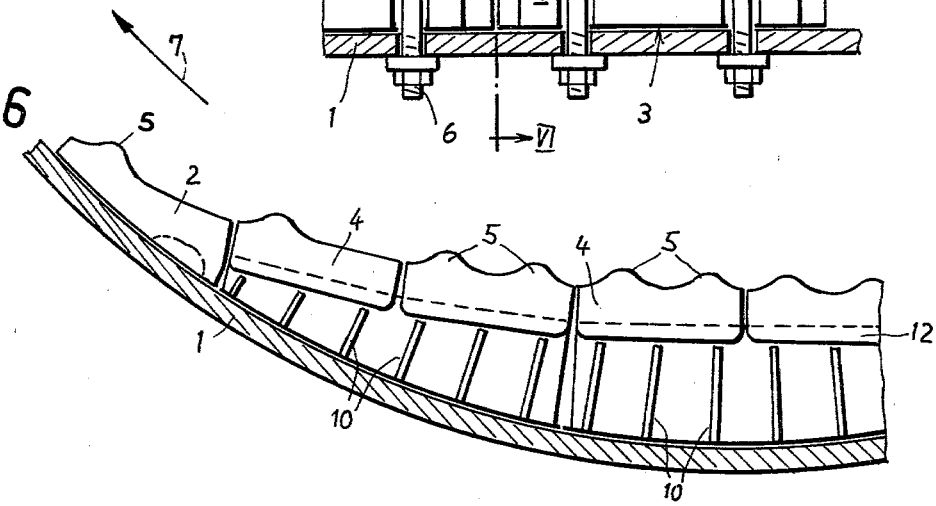
Figure 5A:
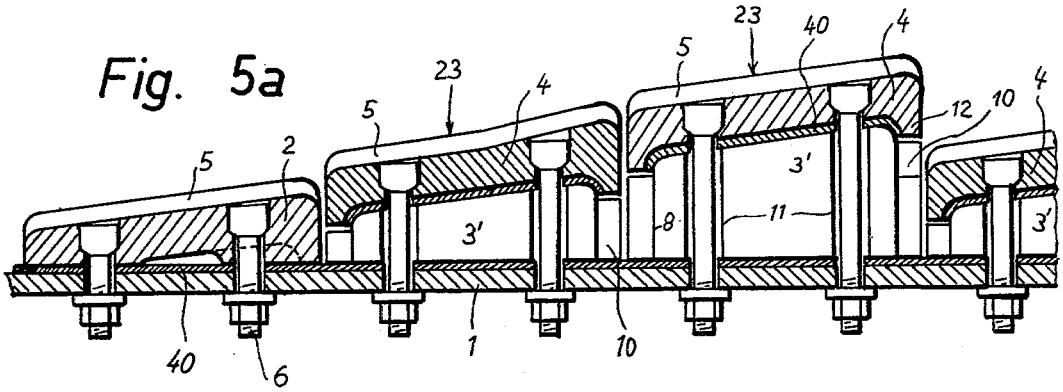
Figure 7:
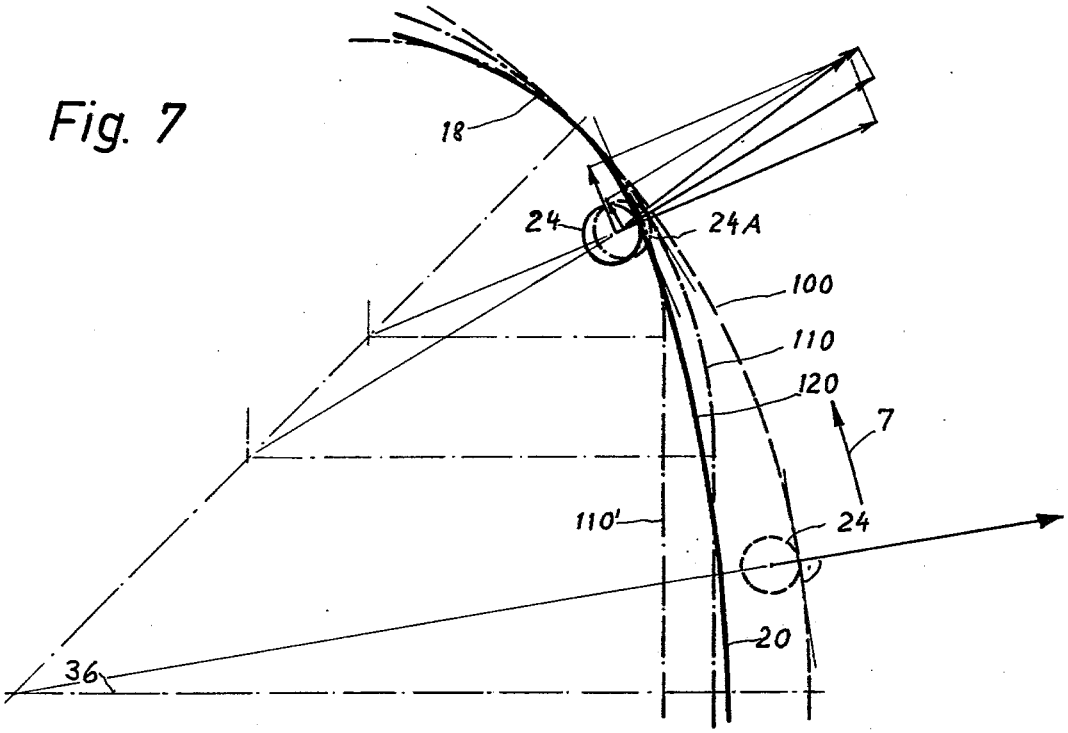

FIG. 4 is a still further enlarged view showing a detail of FIG. 3,

FIG. 5 a sectional view taken on line V—V in FIG. 3,

FIG. 5*a* is a sectional view similar to FIG. 5 showing a modified liner system constructed in accordance with the present invention, FIG. 6 a sectional view taken on line VI—VI in FIG. 5, and FIG. 7 a kinematic analysis of grinding chambers having different cross-sections.

A cylindrical tubular shell 1 is provided on the inside with a lining system 21, which defines a grinding chamber 30, which is approximately polygonal, specifically quadrangular. The lining system 21 comprises a number of individual liner rings 23. Each of the liner rings 23 consists of liner plates and spacers. Certain ones of said liner plates are designated 2 and are directly secured to the shell 1 by bolts 6. Other liner plates 4 are secured to the shell 1 with spacers 3 interposed. The bolts 6 have a shaft 31 and a head 25, which has a bearing surface 26, which is, e.g., spherical and seated in a recess 27 of the liner plate 2, 4. From the recess 27, a bore 28 leads to a bore 29 in the shell 1 or into a tube 11, which extends through a hollow body 3' and serves to guide the bolt shaft 31. The bolts 6 are tightened by means of nuts 32, which are screwed onto the threaded end portions of the bolts 31 and bear on the outside of the shell 1, with lock washers 33 interposed.

The liner plates 2 and 4 are arranged to define a generally polygonal cross-section, which comprises relatively strongly curved corners and slightly curved sides. For this purpose the liner plates 2 which are directly secured to the shell by bolts 6 have a grinding surface 18 which is curved, preferably elliptically curved, whereas the liner plates 4 have the shape of segments of a cylinder in an axial view and a substantially plane grinding surface and are secured to the shell 1 with a spacer 3 interposed.

The spacer 3 on each side of the polygon is composed of a plurality of hollow bodies 3'. Those surfaces 22 of the several hollow bodies 3' which are engaged by the liner plates 4 are inclined relative to each other so that the generally flat grinding surfaces 20 of the liner plates 4 define in cross-section a broken line which approximates an elliptic arc. Each hollow body 3' has such a size that at least two liner plates 4 can be secured to a hollow body 3' by means of bolts 6. This has the advantage that each hollow body 3' and each liner plate 4 can be individually replaced at any time without need for emptying the mill. The fastening bolts 6 extend through the hollow bodies 3' in tubes 11, which are welded to the hollow bodies 3' so that the spacer 3 can be described as a hollow body which is closed on all sides. For sound insulation toward the outside and protection against corrosion on the inside surface, the hollow bodies 3' may be filled with foam in that foamable liquid material is introduced through a bore and is subsequently expanded and cured to form a foam. The bore can then be closed. The bearing engagement between each liner plate and its support can be improved in that an elastic interlayer 40 is interposed. As is apparent from FIG. 5, the side edges of the hollow bodies 3' are covered by flanges 12 of the liner plates 4 in order to prevent a wear of these portions of the spacer. These flanges 12 serve also as guides which facilitate the assembling of the liner plate.

As is apparent from FIG. 2 and partly from FIG. 3, several of the members of lining system 21 which have been described hereinbefore are arranged as closely adjoining liner rings 23, which are juxtaposed in the axial direction of the shell 1 and each of which is angularly offset from the preceding one in such a manner that the corners of the several liner rings are offset in steps in the same direction. Two additional liner rings are indicated in FIG. 1 by dotted lines and by dash-dot lines, respectively and are offset from the intermediate liner ring, which is shown in section. The offset may amount to one or more peripheral pitches of the bores for the screws.

The grinding is effected by grinding elements, which preferably consist of balls of hard material, such as steel. These balls may differ in diameter. By a rotation of the shell, rolling and/or falling motions are imparted to these balls so that they disintegrate the material to be ground. Some of these balls are indicated in FIG. 1 at 24. The mill can be used for wet or dry grinding. In FIG. 1, the position assumed by the contents of the mill during a rotation in the direction indicated by the arrow 7 is indicated by a line 17. The contents consist of the material being ground and the grinding elements.

Particularly during wet grinding operations, a large amount of material to be ground flows in the peripheral direction between the spacers associated with the several liner rings so that the side faces of the spacers are also subjected to wear. To avoid the resulting effects of abrasion and corrosion, radial ribs 10 are provided on the side faces 8 of the hollow bodies 3', which in accordance with the invention constitute the spacers 3. This is apparent from FIG. 1. The ribs 10 may be provided with transverse ribs so that the flow of material on the sides of the spacers is retarded or prevented. The peripheral pitch of the bores for the screws may be an integral multiple of the pitch of these ribs 10.

The liner plates 2 and 4 may be provided with undulations or ribs 5 which precede the fastening bolts 6 in the direction of rotation 7 of the shell. This arrangement affords the advantage that material is removed from the undulation or rib 5 and from the liner plate 2 or 4 on that side which is opposite to the fastening bolt when the contents of the mill slips back in the direction of the arrow 9, opposite to the direction of rotation of the mill. In FIG. 4, the abrasive action of the material being ground is indicated by the arrow 9 and the dotted line 14 represents the configuration of the worn liner plate approximately at the time when the head 25 of the fastening bolt 6 begins to be worn off. It is apparent that the undulation or rib 5 is subjected to wear mainly on the side which faces the contents slipping back and that the undulation or rib 5 virtually migrates as it is worn and finally forms an enlarged portion around the bolt. It is apparent that the provision of undulations or ribs 5 which shelter the fastening bolts from abrasion affords the advantage that the abrasion of the fastening bolts is retarded and the liner plate will be securely fixed even when it has been worn.

The arrangement which has been described results also in a reduction of the slipping movement 9 between the liner plates and the contents of the mill so that a smaller and more uniform wear of the grinding surfaces 18 and 20 of the liner plates 2 and 4 results and the service life of the liner plates is thus prolonged.

The elastic interlayer 40 between each of the liner plates 2 and 4 and the spacer or shell, respectively, results in a snug contact and in a reduced wear because a movement of material between the liner plates, on the one hand, and the spacers and the shell, on the other hand, is prevented. This measure is particularly important during wet grinding.

It will be understood that a plurality of hollow bodies 3' can be replaced by an integral spacer 3 within the scope of the invention, provided that the integral spacer has an angled bearing surface for the liner plates and the angles are disposed between the plates. FIG. 2 shows undulations or ribs which extend parallel to the direction of the mill axis 30 or which cross the direction of the mill axis of the tumbling mill. Such plates can be selectively used in accordance with the most effective type of grinding process required. The last described arrangement will improve the segregation effect on the grinding media charge in the mill. This will eliminate for a major number of cases the need for a construction as shown in FIG. 5*a*, whereas the liner plates 2 have a trapezoidal cross-section and the liner plates 4 are fastened with spacers 3 interposed which show a trapezoidal cross section. An arrangement as shown in FIG. 5*a* may be specially suitable for the fine grinding chamber of large diameter, by dry grinding mills, wherein an accurate segregation effect on the grinding elements may be required for the most effective grinding. An undulation or rib 5 which crosses the axis of rotation of the mill exerts a classifying action on the grinding balls 24 in that the larger grinding balls migrate toward the inlet 34, which is disposed at one end of the shell, and the smaller balls migrate toward the outlet 35, which is disposed at the other end of the shell 1.

Three cross-sectional shapes of a portion of a grinding chamber are shown in FIG. 7. In a tumbling mill having a grinding chamber 100 which is circular in cross-section, the centrifugal force will cause the grinding ball 24 to apply pressure to the liner always in a direction which is normal to a tangent to the cross-section of the grinding chamber so that there is no entraining component of force in the direction of rotation 7 of the mill.

In a tumbling mill which has a polygonal liner consisting of liner plates and having corners which are rounded in accordance with arcs of a circle 110, only a small entraining component of force will be exerted on the grinding balls 24A adjacent to the rounded corners so that the grinding ball falls onto the material to be ground after a short time. In that region 110' the entraining component of force can be increased only by a smaller radius of curvature but this will decrease the volume of the grinding chamber. The liner 120 according to the invention defines the cross-section of the grinding chamber along elliptic arcs 18 and 20 so that a relatively large entraining component of force acts on the grinding ball 24 adjacent to the corners, where the ball is entrained to the largest height, as is proved by the diagram of forces shown on the drawing. This large entraining component of force causes the grinding ball to be entrained to a larger extent in this region than with the two cross-sections discussed first. The grinding ball 24 which has been entrained to a larger extent falls down from a larger height and exerts a stronger impact whereas the volume of the grinding chamber is decreased by the same amount as with the cross-section 110. A consideration of the figure which is in mirror symmetry to the center line 36 shows that the grinding ball 24 is subjected to a stronger reversing component of force adjacent to the corners so that the grinding ball is entrained to a smaller height.

It is apparent from the above that the angle at which the grinding elements are thrown off exhibits a larger variation with the cross-sectional shape 120 according to the invention than with the cross-sectional shapes discussed first. As a result, there is also a larger variation of the parabolic trajectories of the falling grinding elements and a wider zone of impact at the trailing portion of the contents consisting of the grinding elements and material to be ground. As an additional result,the turbulence within the contents will be increased so that the use of the polygonal-volute grinding chamber improves the selective grinding of material passing through.

In addition to imroving the selectivity of the disintegration, the use of the liner according to the invention results in an improved wear pattern because the two elliptic arcs 18 and 20 continuously merge one into the other so that there is no discontinuity in the radial acceleration. For instance, there is an undesired wear at the transition from an arc of a circle to the straight line in the cross-section 110 of the grinding chamber having rounded corners. This increased wear can be decreased in the grinding chamber having the cross-section 120. In mills which are large in diameter, the use of the cross-sectional shape proposed by the invention permits of the use of lower spacers 3 and shorter bolts 6.

What is claimed is:

1. A tumbling mill comprising a cylindrical shell having an inlet and an outlet, said shell being provided on the inside with a lining system defining a grinding chamber which is generally polygonal in cross-section, the grinding chamber having rounded corner portions and side faces which approximate surface portions of an elliptic cylinder, said lining system comprising a plurality of peripheral liner rings, which are disposed on the inside of the shell and juxtaposed in the longitudinal direction of the shell, each of said liner rings having a plurality of peripherally spaced liner plates, which are secured to said shell, and spacers disposed between said liner plates and said shell at least at portions other than said corner portions.

2. A tumbling mill according to claim 1, characterized in that the liner plate disposed at the corners of the cross-section of the grinding chamber have an elliptically curved grinding surface and are directly secured to the shell.

3. A tumbling mill according to claim 1, characterized in that the spacers comprise hollow bodies which are closed on all sides and are substantially rectangular in cross-section and the liner plates have lateral flanges which cover only the top edges of the spacers and extend toward the shell.

4. A tumbling mill according to claim 1, characterized in that the spacers have radial ribs on their side faces for retarding movement of material in the spaces between the side faces.

5. A tumbling mill according to claim 1, characterized in that said liner plates are secured to said shell by means of bolts and nuts and the bolts extend through aligned bores in the liner plate and in the shell, spacers disposed between the liner plate and shell including a tube, the tube being for receiving shafts of said bolts joined to walls of the spacer which are adjacent to the ends of the tube.

6. A tumbling mill according to claim 5, characterized in that the liner plates have elevations, such as ribs or undulations, which cross the axis of rotation of the shell.

7. A tumbling mill according to claim 1, characterized in that an elastic interlayer is disposed between each of said liner plates and its support.

8. A tumbling mill according to claim 1, characterized in that at least one spacer is provided along each side of the cross-section of the grinding chamber to present a plane bearing surface for at least one peripherally spaced liner plate.

9. A tumbling mill according to claim 1, characterized in that each of said liner rings has in cross-section substantially a shape which is similar to a square and has rounded corners and outwardly elliptically curved sides and adjacent liner rings are angularly offset from each other.

10. A tumbling mill according to claim 1, characterized in that the spacers are substantially trapezoidal in cross-section and in that the liner plates have lateral flanges which cover only the top edges of the spacers and extend towards the shell.

* * * * *